US005329718A

United States Patent [19]

Howard

[11] Patent Number: 5,329,718

[45] Date of Patent: Jul. 19, 1994

[54] MAGAZINE

[76] Inventor: William J. Howard, P.O. Box 573, Wilson, N.C. 27893

[21] Appl. No.: 682

[22] Filed: Jan. 5, 1993

[51] Int. Cl.[5] ..... F41A 7/69

[52] U.S. Cl. ..... 42/50; 89/34

[58] Field of Search ..... 42/50, 49.01, 18, 22; 89/34, 33.1

[56] References Cited

U.S. PATENT DOCUMENTS

| | | | |
|---|---|---|---|
| 999,387 | 8/1911 | Mauser | 42/50 |
| 1,350,646 | 8/1920 | Eickhoff | 42/50 |
| 2,366,684 | 1/1945 | Garand | 42/50 |
| 2,434,269 | 1/1948 | Harvey | 42/50 |
| 2,777,235 | 1/1957 | Hopkins | 42/50 |
| 3,222,810 | 12/1965 | Musgrave | 42/87 |
| 3,377,732 | 4/1968 | Bivens | 42/50 |
| 3,399,480 | 9/1968 | Rowe | 42/50 |
| 4,356,653 | 11/1982 | Swieskowski | 42/50 |
| 4,514,922 | 5/1985 | Farrar et al. | 42/50 |
| 4,876,813 | 10/1989 | Tuma | 42/50 |
| 4,888,900 | 12/1989 | Howard | 42/50 |
| 5,081,778 | 1/1992 | Switzer | 42/50 |

FOREIGN PATENT DOCUMENTS

| | | | |
|---|---|---|---|
| 1269918 | 6/1968 | Fed. Rep. of Germany | 42/50 |
| 127277 | 1/1950 | Sweden | 42/50 |

*Primary Examiner*—Stephen M. Johnson
*Attorney, Agent, or Firm*—David R. Murphy

[57] ABSTRACT

A magazine for holding and for reliably and rapidly feeding cartridges to the chamber of a bolt-equipped firearm. Each cartridge to be fed has a rim and a shoulder. The magazine has lips, guides, and a follower. The lips are cartridge-retaining lips, which are uniformly forwardly outwardly angled substantially the entire length of the cartridge from the rim to the neck. The guides guide two parallel rows of cartridges toward the lips. The follower and a spring upwardly bias the two rows of cartridges such that the uppermost cartridge in one row contacts the lip above that row and the uppermost cartridge in the other row contacts the lip above the other row. The walls of the magazine have outwardly flared parallel skirt guides. These skirt guides retain a skirt which has certain features preventing its accidental removal.

8 Claims, 4 Drawing Sheets

MAGAZINE

This invention relates to an improved magazine for reliably feeding cartridges to the chamber of a bolt-equipped firearm.

In recent years there has been a marked increase in the designed rate of fire of hand-held, bolt-equipped firearms. For example the present Model M-16 rifle widely used by the armed forces of the United States of America (USA) and by the forces of the North Atlantic Treaty Organization (NATO) has a normal rate of fire of about 700 rounds per minute (rpm). The recently introduced Model M-249 rifle has a designed rate of fire of 800 to 900 rpm. Other firearms have designed rates of fire of over 1400 rpm. At these higher rates of fire each spent cartridge must be extracted rearwardly from the chamber, and the chamber cleared for the advance of the next cartridge. This next cartridge must be aligned with the chamber and must be moved into the chamber all in less than one twentieth (1/20) of one second (0.05 seconds). The forces necessary to accelerate a cartridge from its at-rest position are enormous. The geometry of the cartridge-guiding surfaces of the magazine are critical to avoid (a) damage to the projectile and (b) jamming of the firearm. Damage to the projectile yields an erratic trajectory. Jamming of the firearm renders it useless until the jam can be cleared. Presently available magazines are not reliable in that they cause damage to the projectile and cause jams.

Another problem with present magazines of organic plastic is their inability to reliably retain their bottom skirt. Loss of this bottom skirt renders the magazine useless.

Accordingly it is an object of the present invention to provide an improved magazine which is substantially free of one or more of the above problems.

Another object is to provide an improved magazine which reliably feeds cartridges at high rates without damaging the projectiles and without jamming the firearm.

Still another object is to provide an improved magazine having a skirt which cannot be easily inadvertently removed.

Figure 1:
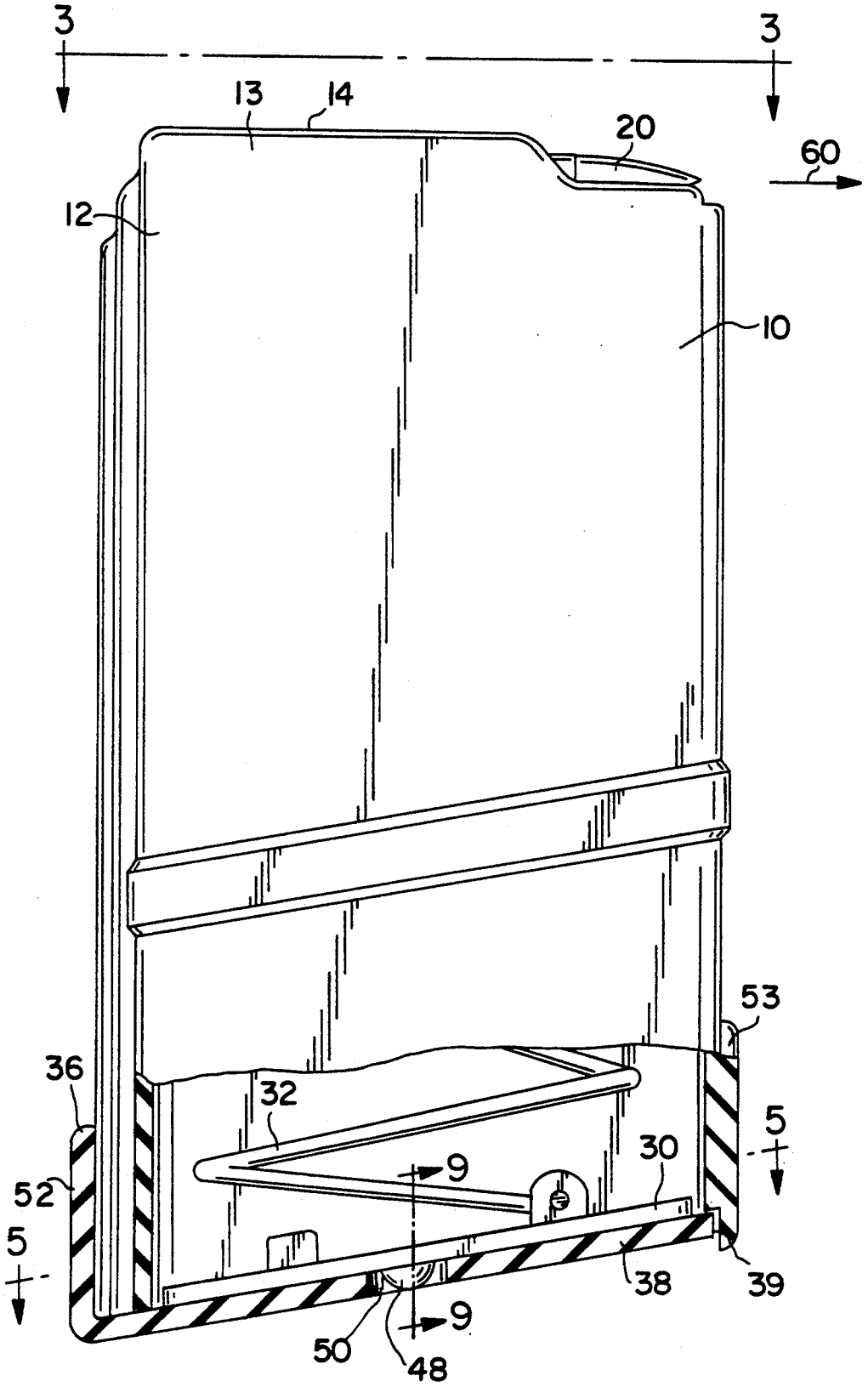
Figure 2:
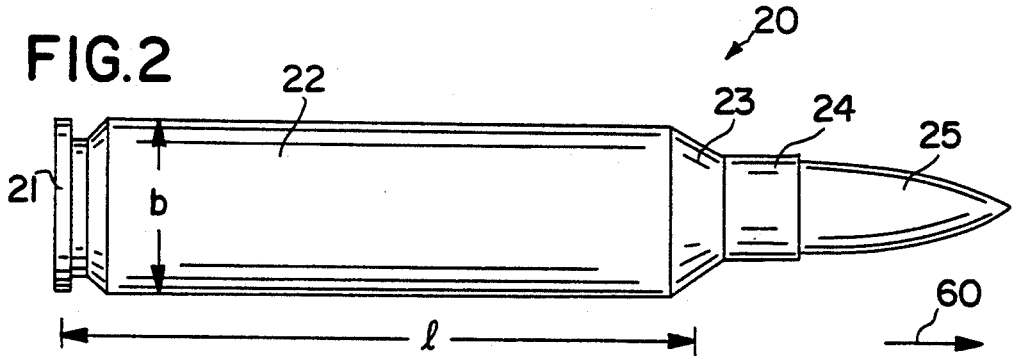
Figure 3:
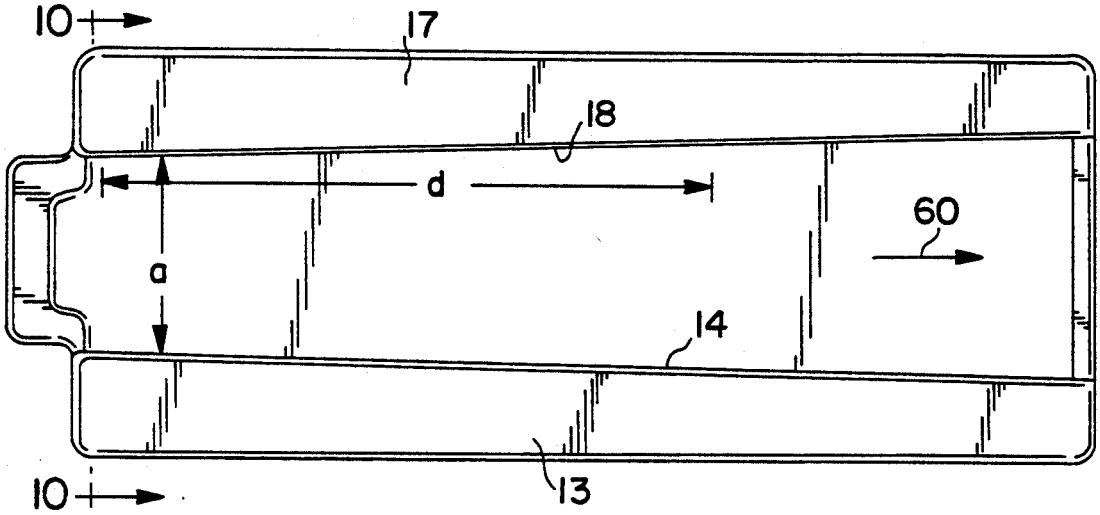
Figure 4:
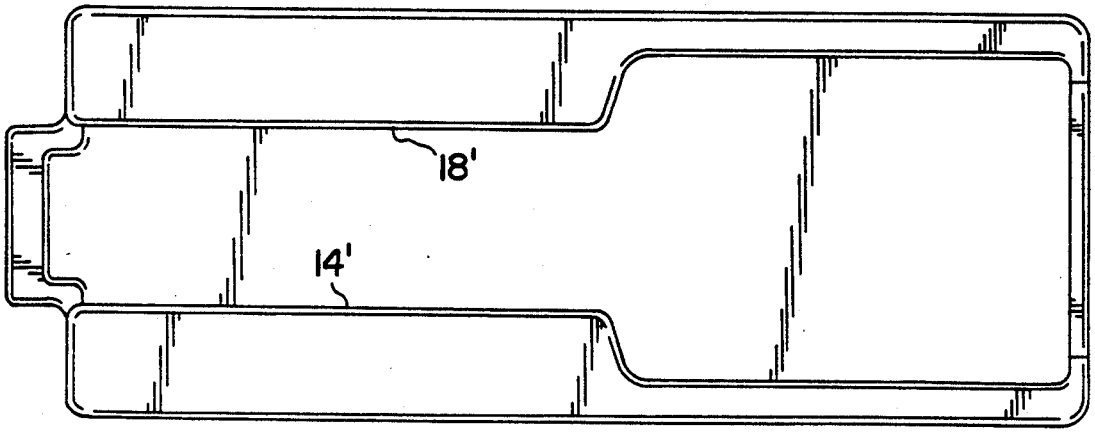
FIG.4 PRIOR ART
Figure 5:
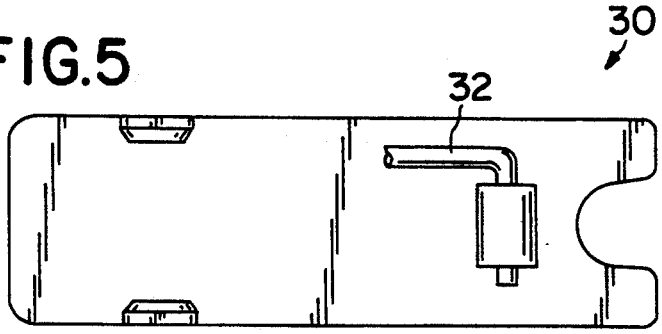
Figure 6:
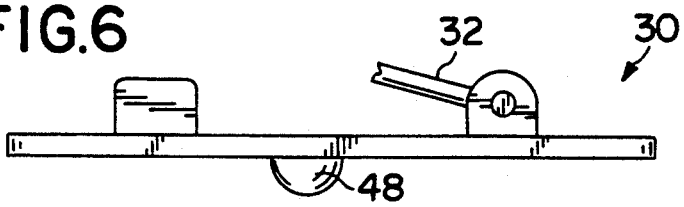
Figure 10:
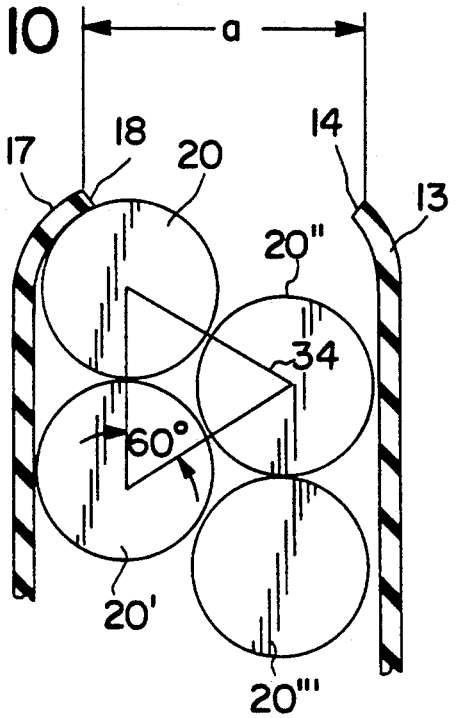
Figure 7:
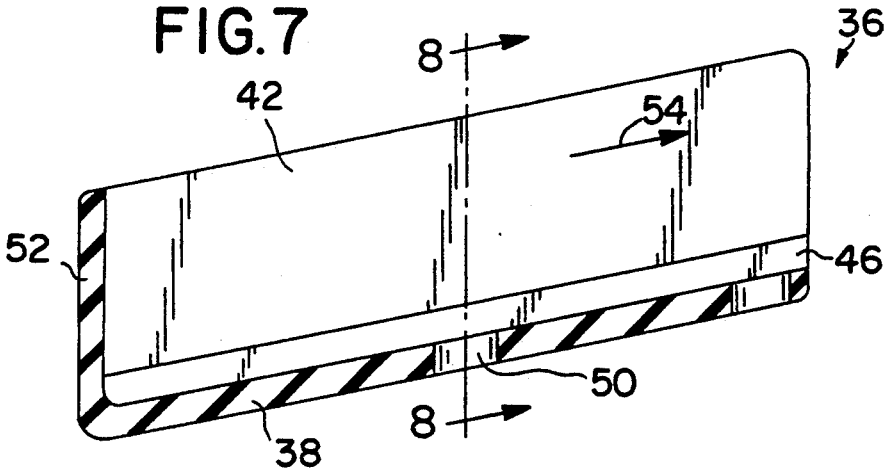
Figure 8:
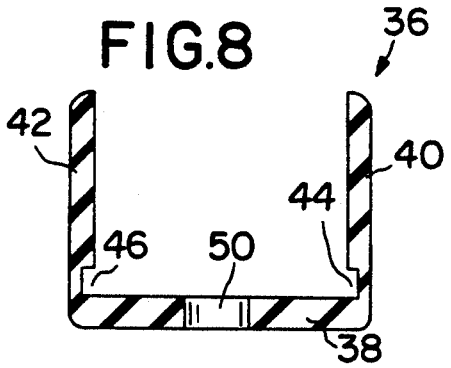
Figure 9:
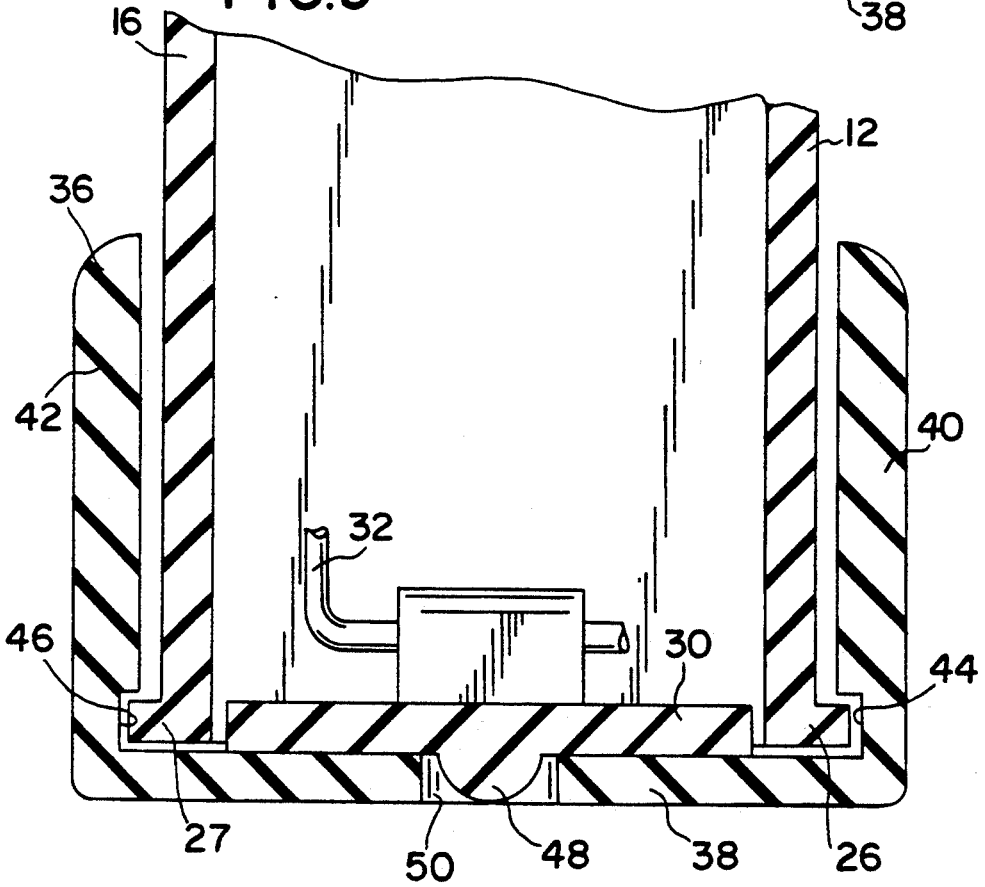

Additional objects and advantages of the present invention will be readily apparent to those skilled in the art by reference to the following detailed description and drawings wherein:

FIG. 1 is an enlarged, side view of an improved magazine of the present invention which view has been cut away to show a butt plate and skirt; and FIG. 2 is a greatly enlarged side view of a cartridge useful in the improved magazine of the present invention; and FIG. 3 is a greatly enlarged top view taken along Line 3—3 of FIG. 1; and FIG. 4 is a greatly enlarged top view of a prior art cartridge; and FIG. 5 is a top view of a butt plate useful in the present invention taken along Line 5—5 of FIG. 1; and FIG. 6 is a side view of the butt plate of FIG. 5; and FIG. 7 is a sectional, side view of the skirt; and FIG. 8 is a sectional view taken along the Line 8—8 of FIG. 7; and FIG. 9 is a sectional view, on a greatly enlarged scale, taken along line 9—9 of FIG. 1; and FIG. 10 is a sectional view taken along line 10—10 of FIG. 3, but showing the cartridges which are omitted in FIG. 3 for clarity.

The above and other objects are accomplished according to the present invention by providing a magazine for holding two parallel rows of cartridges and for reliably, rapidly, forwardly, alternately, feeding the uppermost cartridge from first one row and then from the other row to the chamber of a bolt-equipped firearm. Each cartridge has a rim, a body, a shoulder, a neck, and a projectile in the neck. The magazine comprises a pair of cartridge-retaining lips, guides and a spring.

The end portions of the cartridge-retaining lips are uniformly forwardly outwardly angled a longitudinal distance substantially equal to the length of the cartridge from the rim to the shoulder. At their closest point, they are spaced from each other a distance greater than the diameter of one cartridge at its rim and less than two cartridges at its rim. The magazine has guides which guide the two parallel rows of cartridges toward the cartridge-retaining lips. The magazine also has a spring which functions to upwardly bias the two rows of cartridges such that the uppermost cartridge in one row contacts the lip above that row and the uppermost cartridge in the other row contacts the lip above the other row.

Furthermore some magazines of the present invention have two parallel side walls the lower extremities of which terminate in a pair of outwardly flared parallel skirt guides. These magazines also have a spring constituting means for upwardly biasing the two rows of cartridges such that the uppermost cartridge in one row contacts the lip above that row and the uppermost cartridge in the other row contacts the lip above the other row. These magazines also have a butt plate against which the spring presses as well as a skirt having a bottom wall and two upwardly extending walls. The inside surface of each upwardly extending wall has a recess adapted to receive the outwardly flared parallel skirt guides of the walls of the magazine.

Some magazines of the present invention have a ball is carried by the butt plate to mate with a hole in the skirt.

Referring now to the drawings in general and in particular to FIGS. 1 and 3 there is shown a magazine 10 of the present invention. The magazine 10 comprises a right side wall 12 terminating in a cartridge-retaining lip 13 having a straight end portion 14 and a left side wall 16 (see FIG. 3) terminating in cartridge-retaining lip 17 having a straight end portion 18. The side walls 12, 16 constitute means for guiding two parallel rows (not shown) of cartridges such as the cartridge 20 toward the cartridge-retaining lips lip end portions 14, 18.

The magazine 10 also has a spring 32. The function of the spring 32 is to upwardly bias the two rows (not shown) of cartridges such that the uppermost cartridge 20 in one row contacts the lip lip end portion 14 above that row and the uppermost cartridge (not shown) in the other row contacts the lip 18 above the other row (not shown).

FIG. 2 shows the cartridge 20 of the type useful with the magazine 10 of the present invention. The cartridge 20 has a rim 21 adapted to be held by extractor clips (not shown) carried by the bolt (not shown) of the firearm (not shown). Forward of the rim 21 is the body 22 which is connected to a conical shoulder 23 which is in turn connected to a neck 24. Crimped within the neck 24 is a projectile 25. The cartridge-retaining lip end portions 14, 18 are substantially straight. The lip end portions 14, 18 are uniformly forwardly outwardly angled a longitudinal distance "d" substantially equal to the length "l" of the cartridge 20 from the rim 21 to the shoulder 23. The distance "a" between the lip end portions 14, 18 at their closest point is greater than the diameter "b" of the cartridge 20 when measured near its rim 21. The dimension "a" is also equal to less than "2b" namely twice the diameter of the cartridge 20 at its rim 21.

The differences between the magazine 10 of the present invention and the common prior art magazine 10' are clearly seen by comparing FIGS. 3 and 4. In FIG. 3 the magazine 10 has lip end portions 14, 18 which are uniformly forwardly outwardly angle substantially the entire length of the cartridge 20 from the rim 21 (See FIG. 2) to the neck 24. As shown in FIG. 4, the prior art magazine 10' is completely different in that the lip ends portions, 14', 18' are not outwardly angled but rather are parallel to each other. Furthermore the lip end portions 14', 18' extend forwardly a distance equal to about two thirds of the distance on the cartridge 20 from the rim 21 to the shoulder 23. These structural differences are responsible for the improved rate of fire of the magazine 10 of the present invention.

FIG. 10 shows how the cartridges 20, 20' of one row are offset from the cartridges 20'', 20''' in the other row by an amount equal to one-half the diameter of a single cartridge. Furthermore the centerline of the uppermost three cartridges 20, 20', 20'' describe an equilateral triangle 34, every internal angle of which is equal to 60°.

Referring now to FIGS. 7, 8, and 9 it can be seen that the lower extremity of the right side wall 12 terminates in an outwardly flared skirt guide 26. Similarly the lower extremity of the left side wall 16 terminates in an outwardly flared skirt guide 27. The skirt guides 26, 27 are parallel to each other. The magazine 10 also has a butt plate 30 against which the spring 32 presses.

The magazine 10 is provided with a skirt 36 having a bottom wall 38 having a leading edge 39. The bottom wall 38 is connected to a right upwardly extending wall 40 and to a left upwardly extending wall 42. The inside surface of the right upwardly extending wall 40 has a right recess 44 adapted to receive the right outwardly flared skirt guide 26 of the wall 12. Similarly the left upwardly extending wall 42 has a left recess 46 adapted to receive the left outwardly flared skirt guide 27. The butt plate carries an integrally-formed, downwardly-extending, hemispherical ball 48. The bottom wall 38 of the skirt 36 has a hole 50 which is slightly larger than the diameter of the ball, and is aligned with the ball 48 to receive it.

Disassembly of the magazine 10 is easily achieved in the field without the use of any special tools. To disassemble the magazine 10, the ball 48 is forced upwardly against the pressure of the spring 32 until the ball 48 clears the hole 50. The skirt 36 can then be slid rearwardly until the recesses 44, 46 are completely free of the guides 26, 27. At this point the spring 32 forces the butt plate 30 from the magazine 10. Assembly is, of course, the reverse and can also be accomplished without the use of any special tools. In this connection a cartridge 20 is not a special tool, since one is always readily at hand. The projectile 25 of the cartridge 20 is useful to press the ball 48 upwardly out of the hole 50 in the manner described above.

In the magazine 10 of the present invention the skirt 36 is reliably retained on the magazine 10 and is highly resistant to being knocked off irrespective of the direction from which force is exerted. If force is exerted from above, the skirt 36 is held by the upper surfaces of the guides 26, 27 pressing against the upper surfaces of the recesses 44, 46. If force is exerted forwardly, the rear wall 52 resists. If force is exerted rearwardly, the skirt 36 remains in place as long as the ball 48 is in the hole 50.

The magazine 10 carries an integrally formed shield 53 (see FIG. 1). The shield 53 extends downwardly past the leading edge 39 of the bottom wall 38 of the skirt 36. This prevents contact of the leading edge 39 with a foreign body such as the ground. It is, therefore virtually impossible for a foreign body to inadvertently contact the leading edge 39. This inability to contact the leading edge 39 makes it almost impossible to inadvertently apply rearward force.

The magazine 10 of the present invention can be constructed of metal, plastic or other material, but is preferably constructed of organic plastic. A wide variety of plastics can be employed if they have the proper physical properties of strength, resilience, and toughness. Plastics such as polyesters, polyamides, and polyolefins such as polyethylene or polypropylene are potential candidates. The magazine of the present invention can be constructed from a thermoplastic composition of nylon, glass fibers and carbon black. The preferred material is a glass fiber-filled nylon sold by the Dupont Chemical Company under the tradename ZYTEL. The preferred material also includes carbon black.

It is completely surprising and unexpected that the configuration of the cartridge 10 of the present invention including the lip end portions 14, 18, would result in fewer jams and therefore a higher sustained rate of fire. Although there is no desire to limit the invention to any particular theory of operation, it appears that the structure of the lip end portions 14, 18 reduces or eliminates a rocking motion that the top cartridge seems to assume when the bolt (not shown) retreats rearwardly to just that point when the projectile of the cartridge begins to rise. In the prior art the projectile can rise further because the prior art lip end portions 14', 18' are about one-third of the way back on the cartridge, whereas the inventive lip end portions 14, 18 contact the cartridge in the vicinity of the neck 24.

As used herein the terms "forward" and "forwardly" mean in the direction of the target, namely in the direction of the arrow 60 shown in several of the figures. The terms "rearward" and "rearwardly" refer, of course, to the opposite direction.

Although the invention has been described in considerable detail with reference to a preferred embodiment thereof, it will be apparent to those skilled in the art that the present invention can be modified without departing from the spirit and scope of the invention as described above and as defined in the appended claims.

What is claimed is:

1. A magazine for holding two parallel rows of cartridges and for reliably, rapidly, forwardly, alteratively, feeding the uppermost cartridge from first one row and then from the other row to the chamber of a bolt-equipped firearm; wherein each said cartridge has a given length, a rim having a given diameter, a body, a shoulder, a neck, and a projectile in the neck; said magazine comprising:

A. a pair of cartridge-retaining lips terminating in edge portions,
(1) which are uniformly forwardly outwardly angled a longitudinal distance substantially equal to the length of the cartridge from the rim of the shoulder; and
(2) which at their closest point are spaced from each other a distance greater than the diameter of one cartridge at its rim and less than two cartridges at their rims; and
B. means for guiding the two parallel rows of cartridges toward the cartridge-retaining lips; and
C. means for upwardly biasing the two rows of cartridges such that the uppermost cartridge in said one row contacts the edge portion of the lip above that row and the uppermost cartridge in the other row contacts the edge portion of the lip above the other row.

2. The magazine of claim 1 wherein the edge portions of the cartridge-retaining lips are substantially straight.

3. The magazine of claim 1 constructed substantially completely of thermoplastic.

4. The magazine of claim 3 wherein the thermoplastic is nylon.

5. The magazine of claim 3 wherein the thermoplastic is polypropylene.

6. The magazine of claim 1 constructed from a thermoplastic composition of nylon, glass fibers and carbon black.

7. A magazine for holding two parallel rows of cartridges and for reliably, rapidly, forwardly, alternately, feeding the uppermost cartridge from first one row and then from the other row to the chamber of a bolt-equipped firearm; and
wherein each said cartridge has a given length, a rim having a given diameter, a body, a shoulder, a neck, a centerline, and a projectile in the neck; and
wherein the centerline of each of the uppermost three cartridges describe an equilateral triangle, each internal angle of which is equal to 60°; and
wherein said magazine is constructed from a thermoplastic composition of nylon, glass fibers and carbon black; and
said magazine comprising:
A. a pair of curve cartridge-retaining lips terminating in edge portions,
(1) which are uniformly forwardly outwardly angled a longitudinal distance substantially equal to the length of the cartridge from the rim to the shoulder; and
(2) which at their closest point are spaced from each other a distance greater than the diameter of one cartridge at its rim and less than two cartridges at their rims; and
(3) wherein the said cartridge-retaining lips are substantially straight; and
B. means for guiding the two parallel rows of cartridges toward the cartridge-retaining lips; and
C. means for upwardly biasing the two rows of cartridges such that the uppermost cartridge in said one row contacts the edge portion of the lip above that row and the uppermost cartridge in the other two contacts the edge portion of the lip above the other row; and
D. two parallel side walls the upper extremities of which terminate in said pair of cartridge-retaining lips the lower extremities of which terminate in a pair of outwardly flared parallel skirt guides; and
E. means for guiding said two parallel rows of cartridges toward the cartridge-retaining lips; and
F. a spring constituting means for upwardly biasing the two rows of cartridges such that the uppermost cartridge in said one row contacts the lip above that row and the uppermost cartridge in the other row contacts the lip above the other row; and
G. a but plate against which the spring presses; and
H. a skirt having a bottom wall and two upwardly extending walls, wherein the inside surface of each upwardly extending wall has a recess adapted to receive the outwardly flared parallel skirt guides of the walls of the magazine; and
wherein a ball is carried by the butt place and wherein the skirt has a hole to receive the ball.

8. A magazine for holding two parallel rows of cartridges and for reliably, rapidly, forwardly, alteratively, feeding the uppermost cartridge from first one row and then from the other row to the chamber of a bolt-equipped firearm; and
wherein each said cartridge has a given length, a rim having a given diameter, a body, a shoulder, a neck, and a projectile in the neck; and
wherein said magazine is constructed from a thermoplastic composition of nylon, glass fibers and carbon black; and
said magazine comprising:
A. a pair of curved cartridge-retaining lips terminating in straight edge portions,
(1) which are uniformly forwardly outwardly angled a longitudinal distance substantially equal to the length of the cartridge from the rim to the shoulder; and
(2) which at their closest point are spaced from each other a distance greater than the diameter of one cartridge at its rim and less than two cartridges at their rims; and
(3) wherein the said cartridge-retaining lips are substantially straight over their entire length; and
B. means for guiding the two parallel rows of cartridges toward the cartridge-retaining lips; and
C. means for upwardly biasing the two rows of cartridges such that the uppermost cartridge in said one row contacts the entire edge portion of the lip above that row and the uppermost cartridge in the other row contacts the entire edge portion of the lip above the other row; and
D. two parallel side walls the upper extremities of which terminate in said pair of cartridge-retaining lips the lower extremities of which terminate in a pair of outwardly flared parallel skirt guides; and
E. means for guiding said two parallel rows of cartridges toward the cartridge-retaining lips; and
F. a spring constituting means for upwardly biasing the two rows of cartridges such that the uppermost cartridge in one row contacts the entire edge portion of the lip above that row and the uppermost cartridge in the other row contacts the entire edge portion of the lip above the other row.

* * * * *